US009397446B2

(12) United States Patent
Takagi

(10) Patent No.: US 9,397,446 B2
(45) Date of Patent: Jul. 19, 2016

(54) TERMINAL LOCKING STRUCTURE FOR ELECTRICAL CONNECTOR

(71) Applicant: SMK Corporation, Tokyo (JP)

(72) Inventor: Tetsuya Takagi, Toyama (JP)

(73) Assignee: SMK Corporation, Tokyo (JP)

( * ) Notice: Subject to any disclaimer, the term of this patent is extended or adjusted under 35 U.S.C. 154(b) by 14 days.

(21) Appl. No.: 14/510,690

(22) Filed: Oct. 9, 2014

(65) Prior Publication Data

US 2015/0104965 A1 Apr. 16, 2015

(30) Foreign Application Priority Data

Oct. 10, 2013 (JP) ..... 2013-212396

(51) Int. Cl.

| | |
|---|---|
| ***H01R 13/62*** | (2006.01) |
| ***H01R 13/642*** | (2006.01) |
| ***H01R 13/432*** | (2006.01) |
| *H01R 13/52* | (2006.01) |
| *H01R 13/627* | (2006.01) |

(52) U.S. Cl.

CPC ..... *H01R 13/642* (2013.01); *H01R 13/432* (2013.01); *H01R 13/5202* (2013.01); *H01R 13/6273* (2013.01)

(58) Field of Classification Search

CPC .. H01R 13/625; H01R 13/6275; H01R 13/64; H01R 13/642

USPC ..... 439/310, 311, 332, 709, 752.5

See application file for complete search history.

(56) References Cited

U.S. PATENT DOCUMENTS 4,698,030 A * 10/1987 Ryll ..... H01R 13/436 439/732

8,491,344 B2 * 7/2013 Ishibashi ..... H01R 13/4223 439/752.5

FOREIGN PATENT DOCUMENTS

JP 2005-158330 A 6/2005

* cited by examiner

*Primary Examiner* — Vanessa Girardi

(74) *Attorney, Agent, or Firm* — Locke Lord LLP

(57) ABSTRACT

Provided is a terminal locking structure for an electrical connector excellent in assembly even when the locking position of a lance of a terminal is restricted, wherein, in the terminal locking structure that locks a terminal into a housing of the electrical connector with a lance, the terminal includes the lance and a stabilizer on an outer circumference of a cylindrical part thereof, the housing includes: an insertion part into which the terminal is inserted; a lance locking part provided only at a predetermined position along an inner circumference of the insertion part; and a guide part for the stabilizer, the guide part being inserted along the insertion part.

1 Claim, 7 Drawing Sheets

TERMINAL LOCKING STRUCTURE FOR ELECTRICAL CONNECTOR

CROSS-REFERENCE TO RELATED APPLICATION

This application claims priority of Japanese Patent Application No. 2013-212396 filed Oct. 10, 2013, which is incorporated herein by reference in its entirety.

BACKGROUND

1. Technical Field

The present invention relates to a terminal locking structure for an electrical connector.

2. Related Art

In the field of electrical connectors for cable connections using electrical socket and plug connectors, such as electrical cable connectors for solar panels, a cylindrical terminal 20 provided with a lance 22*a* on the outer circumference thereof is inserted into an insertion part 112 of a housing 111 and the lance 22*a* are locked in a locking part 114 as shown in FIG. 7, for example.

In this case, the locking part 114 is formed in a stepped shape over the entire inner circumference thereof, and thus the direction in which the terminal is inserted is not limited but the lances can be properly locked by inserting the terminal at any angle around the circumference of 360 degrees.

If, however, a region 15 without any locking part is present because the locking part 14 for lances cannot be provided owing to restriction in fitting with a counterpart connector, strength setting, or the like as shown in FIG. 1, for example, there is a problem that the terminal cannot be locked and held in the housing if lances are inserted toward the region 15 without any locking part.

Furthermore, if the terminal is turned after locking the terminal in the housing, the lances may come off and detach from the locking part.

JP 2005-158330 A discloses, in a method for attaching a terminal into a housing, a technique of providing a positioning protrusion that comes in contact with the housing when the terminal is incorrectly inserted, so as to prevent incorrect insertion. This technique, however, does not guide the terminal so that the terminal is inserted in a proper direction.

SUMMARY

An objective of the present invention is to provide a terminal locking structure for an electrical connector excellent in assembly even when the locking position of lances is restricted.

A terminal locking structure for an electrical connector according to the present invention is a terminal locking structure for an electrical connector that locks a terminal into a housing of the electrical connector with a lance, wherein the terminal includes the lance and a stabilizer on an outer circumference of a cylindrical part thereof, the housing includes: an insertion part into which the terminal is inserted; a lance locking part provided only at a predetermined position along an inner circumference of the insertion part; and a guide part for the stabilizer, the guide part being inserted along the insertion part, and when the terminal is inserted into the insertion part of the housing, the stabilizer turns along the circumference along the guide part, which rotates the terminal to guide the lance to the lance locking part provided at the predetermined position of the housing.

In the present invention, an electrical connector is a connector that connects a cable to a terminal, inserts the terminal into an insulating housing and locking the terminal with a lance, and is applied to both socket connectors and plug connectors.

Since insertion of the terminal into the insertion part of the housing in this manner brings the stabilizer in sliding contact with and along the guide part so that the lance comes to the predetermined position, the terminal can be inserted at any angle around the circumference for attaching the terminal into the housing even when the locking position of the lance is restricted.

In the present invention, three or more stabilizers may be provided along the circumference of the cylindrical part, the guide part may have a tapered shape that becomes wider from a terminal insertion end toward a terminal insertion rear portion thereof, the terminal may be rotated while being inserted so that the guide part is positioned between two adjacent stabilizers of the stabilizers and the lance is guided to the predetermined position.

As a result, the terminal is positioned so that the guide part is inserted between the adjacent stabilizers, which can restrict rotation of the terminal and the lance is prevented from coming off the locking part after the terminal is inserted and attached into the housing owing to rotation of the terminal.

Effects of the Invention

The terminal locking structure according to the present invention allows the stabilizer of the terminal to be turned and guided to the predetermined position by the guide part of the housing even when the locking position of the lance is restricted, which eliminates restriction of the angle around the circumference at which the terminal is inserted into the housing, and the terminal locking structure is therefore excellent in assembly.

DETAILED DESCRIPTION

A terminal locking structure for an electrical connector according to the present invention can be applied to various connectors, and an example in which the terminal locking structure is applied to waterproof connectors for connecting solar panels will be described below.

Figure 1:
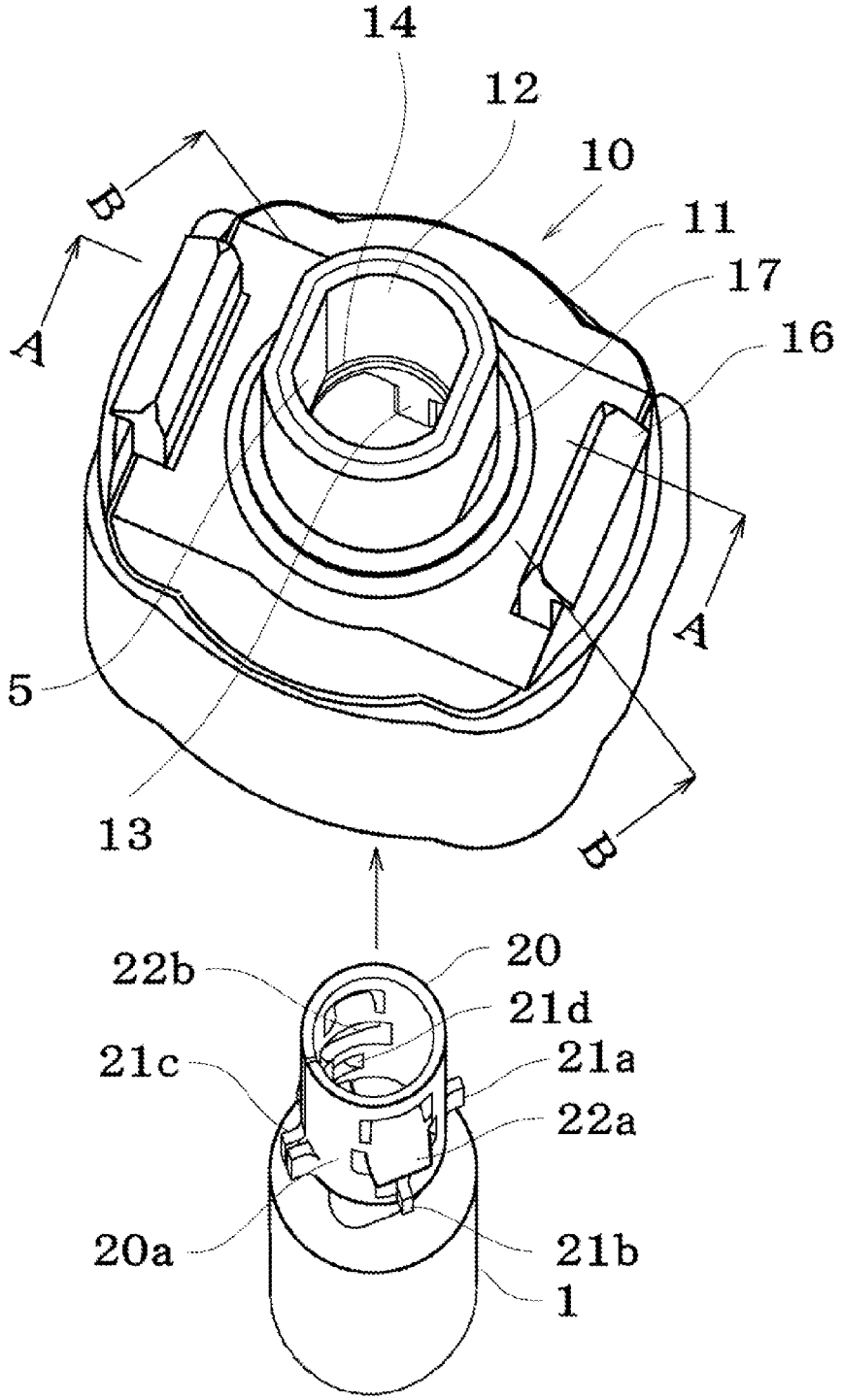
FIG. 1 is a perspective view showing a state in which a terminal is inserted and attached into a housing of an electrical connector from the rear of the housing.

As shown in FIG. 1, a terminal 20 is inserted and attached into an insertion part 12 of a housing 11 made of resin of a connector 10 from the rear of the connector 10.

The insertion part 12 is provided with a guide part 13 and a lance locking part 14.

In this example, the housing 11 is provided with fitting pawls 16 on both sides thereof for fitting with a counterpart connector and a waterproof O-ring 17.

In this example, the terminal 20 is made of metal and provided with four stabilizers 21*a* to 21*d* formed by cutting and raising a cylindrical part 20*a* at equal interval along the outer circumference thereof and two lances 22*a* and 22*b*.

The terminal 20 is connected with a cable 1.

Figure 2:
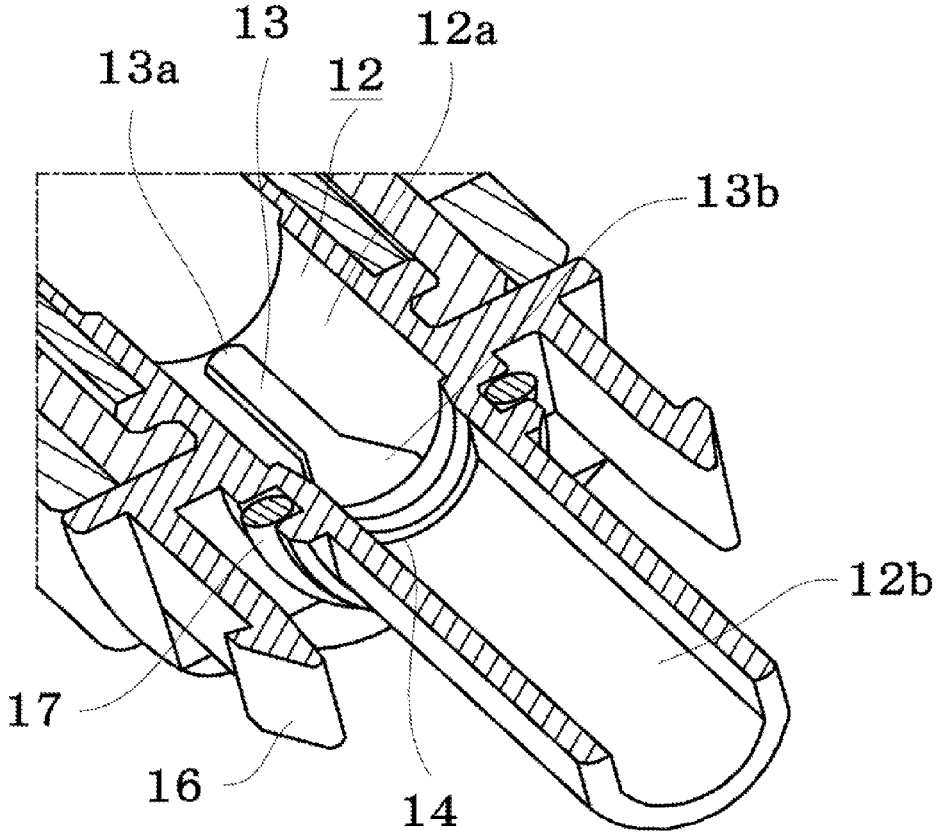
FIG. 2 is a cross-sectional perspective view taken along line A-A.
Figure 3A:
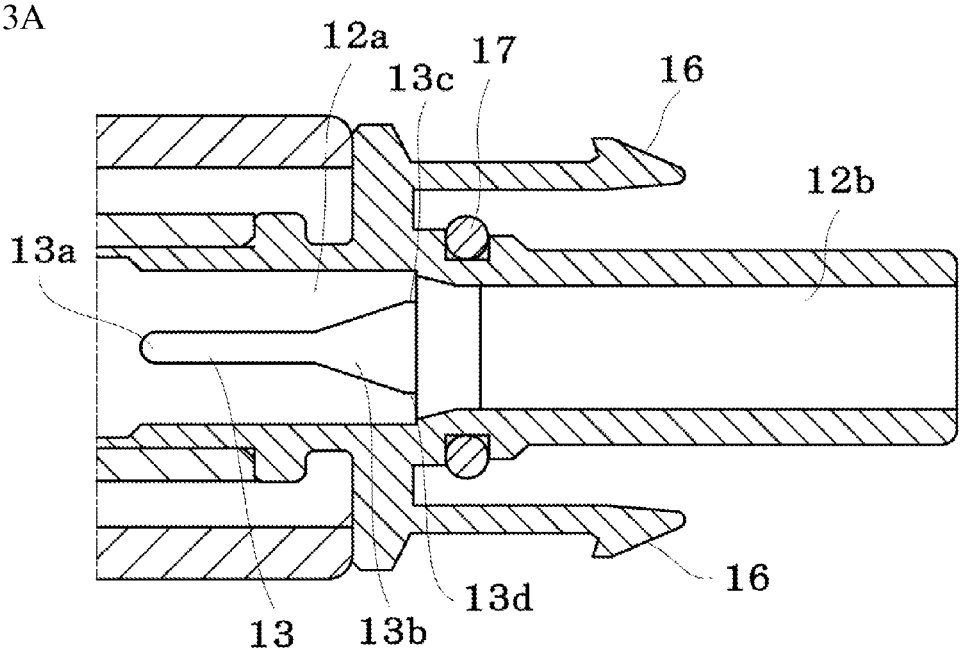
FIG. 3A is a sectional view taken along line A-A.
Figure 3B:
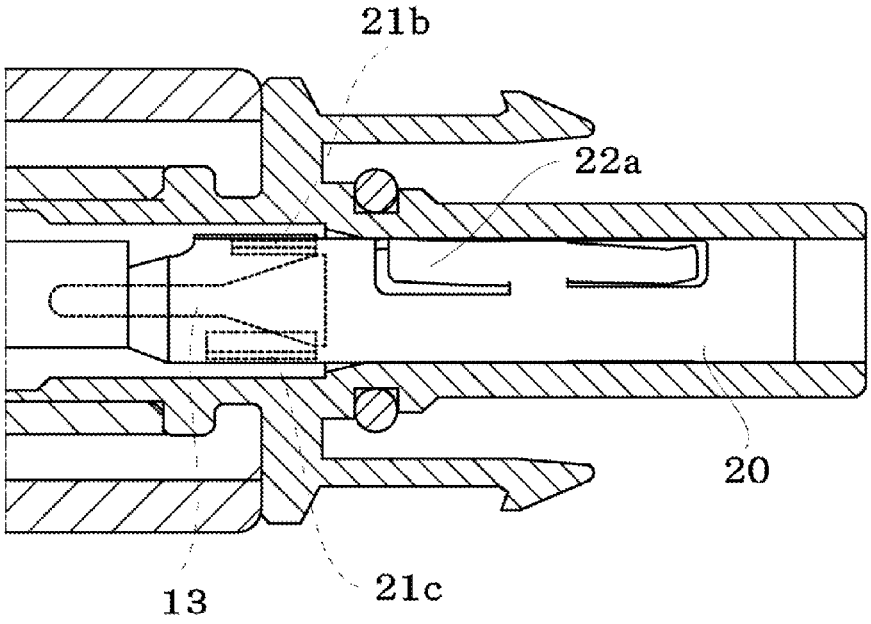
FIG. 3B shows, by a dotted line, relative positions of a stabilizer and a guide part in a state in which the terminal is attached.
Figure 4A:
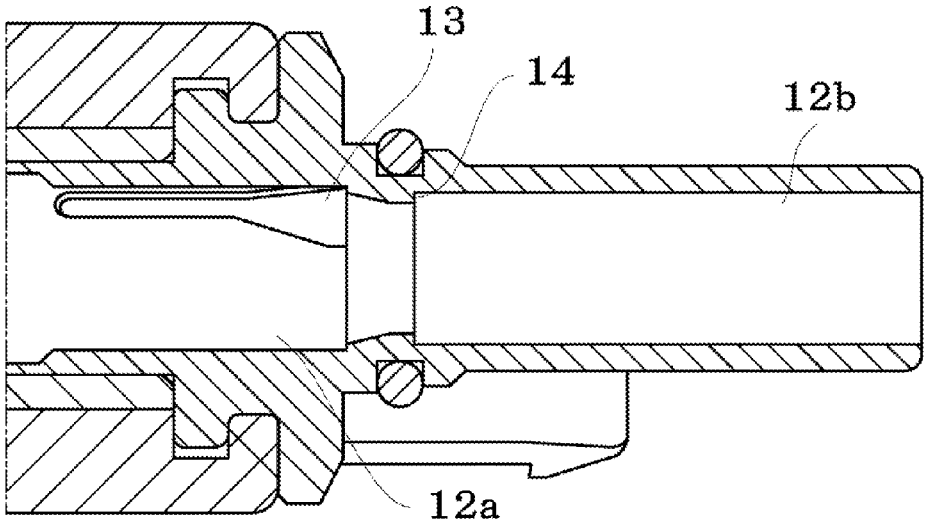
FIG. 4A is a sectional view taken along line B-B.
Figure 4B:
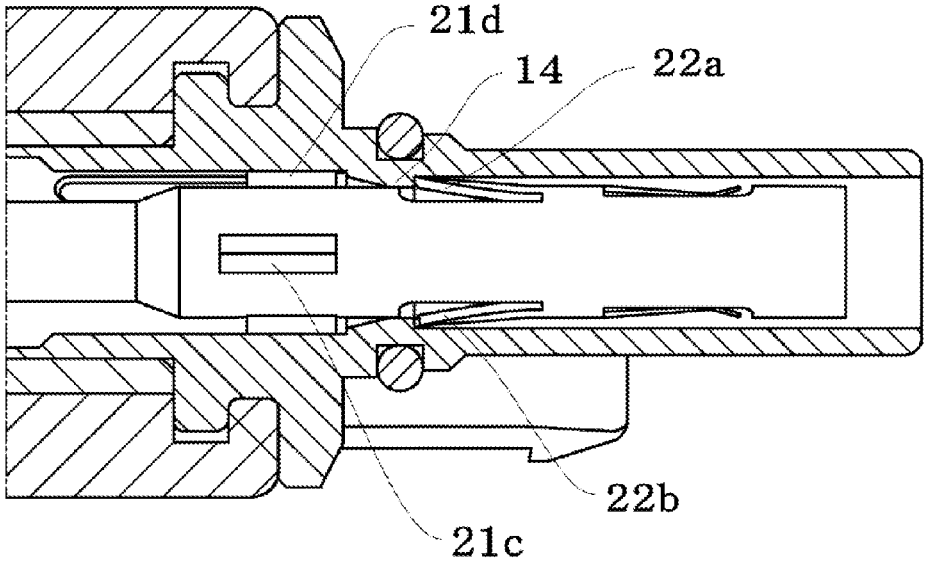
FIG. 4B shows a state after the terminal is attached.

The present embodiment is an example of a waterproof socket connector as shown in FIGS. 2, 3A and 3B which are sectional views taken along line A-A in FIG. 1 and in FIGS. 4A and 4B which are sectional views taken along line B-B.

The insertion part 12 into which the terminal 20 is to be inserted and attached has a cylindrical terminal insertion part 12*b* in which a socket terminal part that can be fit and connected with a plug terminal of the counterpart connecter is placed and a stabilizer insertion part 12*a* at the rear of which the stabilizers 21*a* to 21*d* are to be positioned.

The terminal insertion part 12*b* also has, on the base side thereof, a stepped locking part 14 for locking the lances.

Figure 6A:
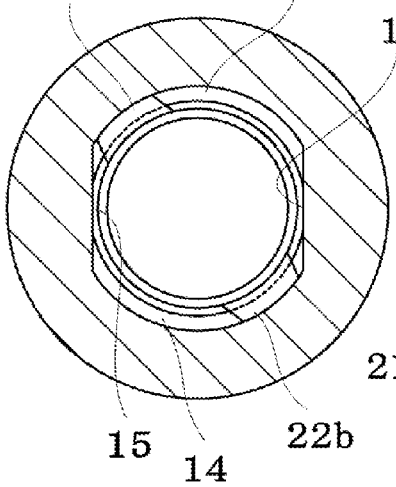
FIG. 6A is a sectional view of lances and a locking part.

The locking part 14 is shown in a perspective view in FIG. 1, and as shown in the sectional view of FIG. 6A, the stepped locking part 14 capable of locking the lance 22*a* can be provided only partially and a region 15 where no locking part is formed is present owing to strength setting in this example.

The stabilizer insertion part 12*a* has a circular cross-section, and is provided, on the inner circumference thereof, with a guide part 13 protruding in a rib-like shape and having a tapered shape with a smaller width at a terminal insertion end 13*a* and a larger width at a terminal insertion rear portion 13*b* thereof as shown in FIGS. 1, 2, 3A and 3B.

Figure 5A:
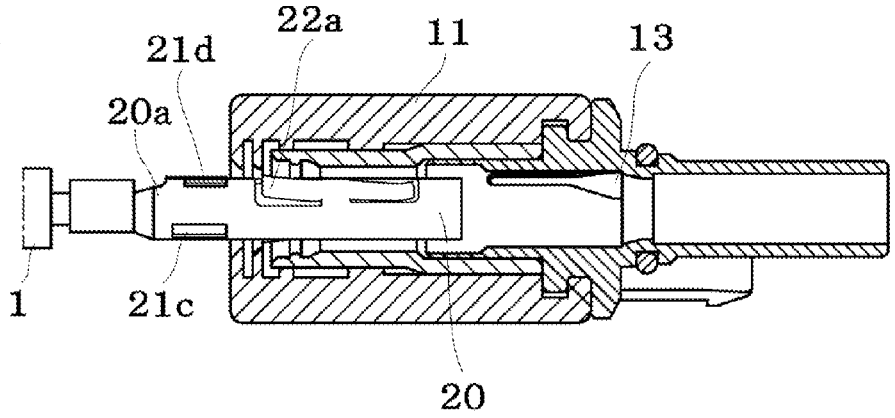
FIGS. 5A to 5C are explanatory views for explaining that insertion of the terminal into an insertion part of the housing brings the stabilizer into sliding contact with the guide part and turns the terminal in the direction W.
Figure 5B:
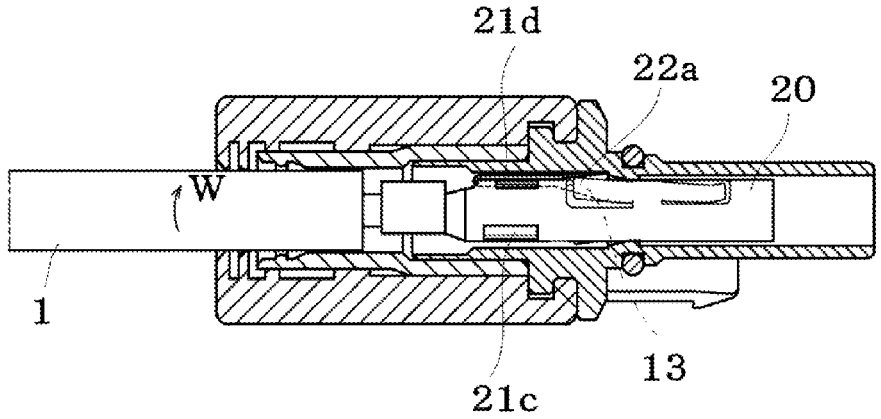
Figure 5C:
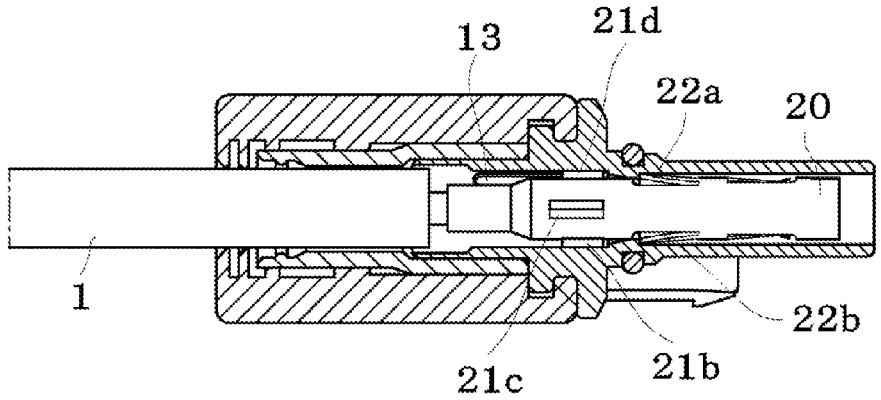

When the terminal 20 is inserted into the insertion part 12 from the rear of the housing 11 at a certain angle around the circumference as shown in FIG. 5A, the stabilizers 21*a* to 21*d* are inserted along sidewalls 13*c* and 13*d* of the guide part 13 as shown in FIG. 5B, which turns the cable and the terminal in the direction of an arrow W and locks the lances 22*a* and 22*b* by the locking part 14 provided at a predetermined position as shown in FIG. 5C.

FIG. 3B shows, by a dotted line, a state in which the stabilizers 21*b* and 21*c* are inserted along the side walls on both sides of the guide part 13.

The guide part 13 guides insertion of the stabilizers 21*a* to 21*d* to guide the locking position of the lances to a predetermined position, and at the same time, comes between adjacent stabilizers 21*b* and 21*c* on both sides thereof, which restricts free rotation of the terminal.

Figure 6B:
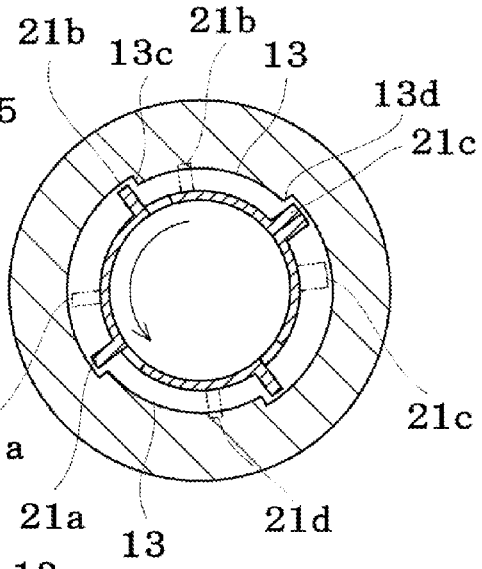
FIG. 6B is a sectional view of the stabilizer and the guide part.

Such operation is shown in the sectional view of FIG. 6B.

Figure 6C:
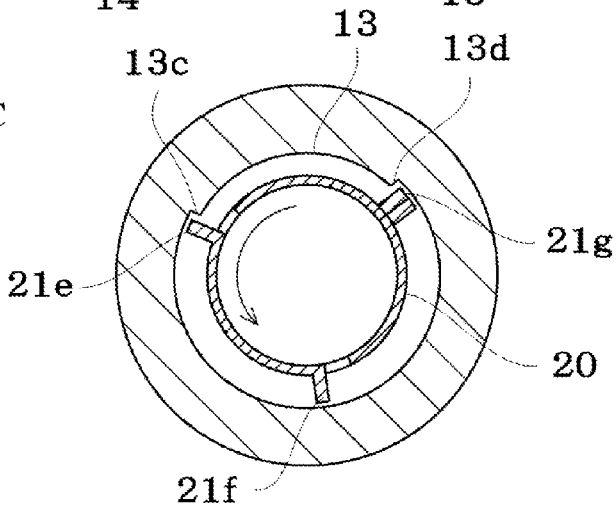
FIG. 6C shows an example of a guide part having three stabilizers.
Figure 7:
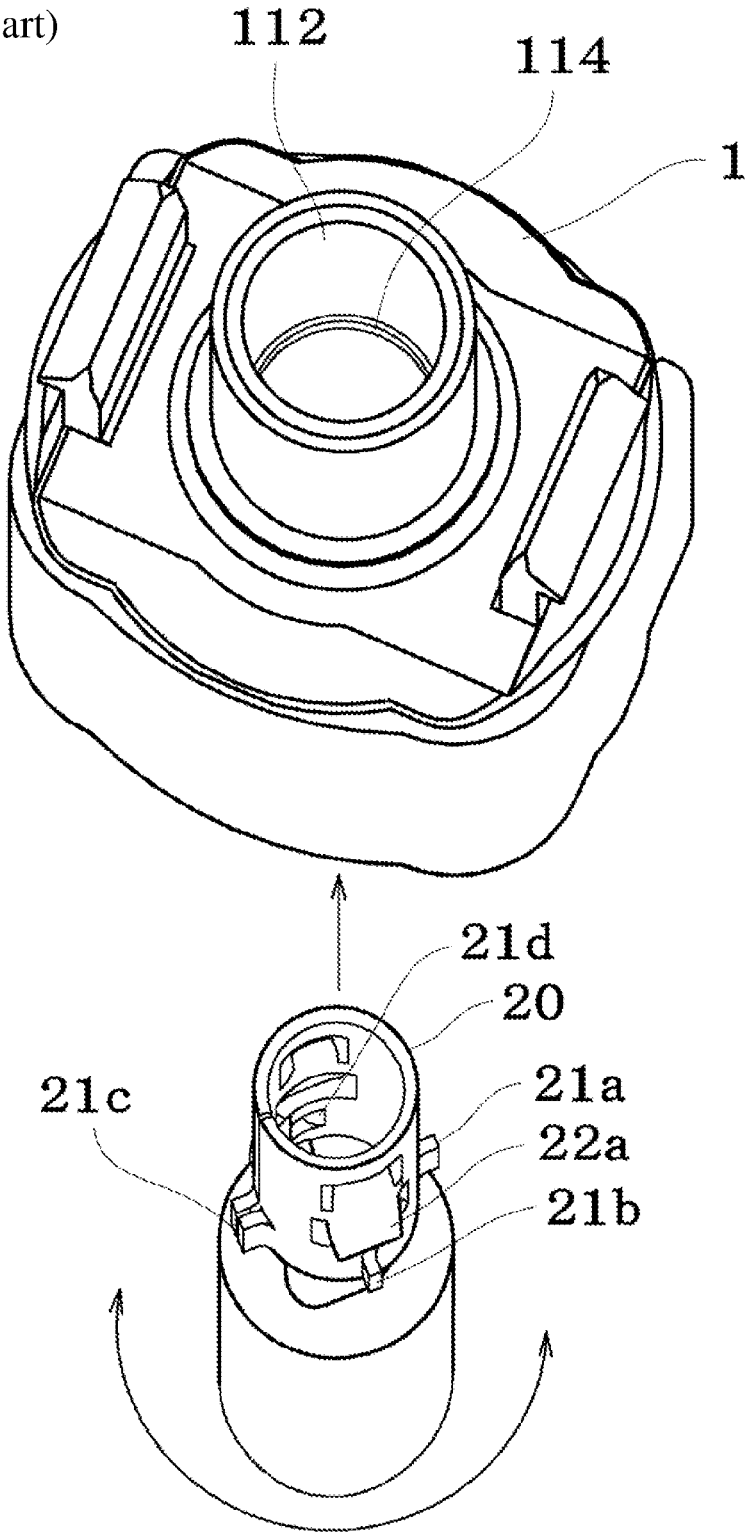
Fig. 7 (related art)
FIG. 7 shows an example structure of a housing of a related art.

While four stabilizers 21*a* to 21*d* are provided in the present embodiment, FIG. 6C shows an example of three stabilizers 21*e* to 21*g*.

REFERENCE SIGN LIST

1 cable
10 connector
11 housing
12 insertion part
13 guide part
14 locking part
20 terminal
21*a* stabilizer
22*a* lance

What is claimed is:

1. A terminal locking structure for an electrical connector that locks a terminal into a housing of the electrical connector with a lance, wherein the terminal includes the lance and a stabilizer on an outer circumference of a cylindrical part thereof, the housing includes:

an insertion part into which the terminal is inserted;

a lance locking part provided only at a predetermined position along an inner circumference of the insertion part; and a guide part for the stabilizer, the guide part being inserted along the insertion part, and when the terminal is inserted into the insertion part of the housing, the stabilizer turns along the circumference along the guide part, which rotates the terminal to guide the lance to the lance locking part provided at the predetermined position of the housing, wherein three or more stabilizers are provided along the circumference of the cylindrical part, the guide part has a tapered shape that becomes wider from a terminal insertion end toward a terminal insertion rear portion thereof, the terminal is rotated while being inserted so that the guide part is positioned between two adjacent stabilizers of the stabilizers and the lance is guided to the predetermined position.

* * * * *